US009115635B2

(12) United States Patent
Abou-Nasr et al.

(10) Patent No.: US 9,115,635 B2
(45) Date of Patent: Aug. 25, 2015

(54) INFERRED ENGINE LOCAL TEMPERATURE ESTIMATOR

(71) Applicant: Ford Global Technologies, LLC, Dearborn, MI (US)

(72) Inventors: Mahmoud Abou-Nasr, Canton, MI (US); Colby Jason Buckman, Brownstown, MI (US); Dimitar Petrov Filev, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 228 days.

(21) Appl. No.: 13/849,416

(22) Filed: Mar. 22, 2013

(65) Prior Publication Data

US 2014/0283764 A1 Sep. 25, 2014

(51) Int. Cl.

| | |
|---|---|
| ***F02B 25/14*** | (2006.01) |
| ***F02F 1/22*** | (2006.01) |
| ***F02B 33/04*** | (2006.01) |
| ***F01P 3/20*** | (2006.01) |
| ***F01P 7/16*** | (2006.01) |
| *F02B 61/04* | (2006.01) |
| *F02B 75/02* | (2006.01) |

(52) U.S. Cl.

CPC ..... *F01P 7/167* (2013.01); *F01P 7/162* (2013.01); *F01P 3/20* (2013.01); *F01P 2025/32* (2013.01); *F01P 2025/33* (2013.01); *F01P 2025/62* (2013.01); *F02B 25/14* (2013.01); *F02B 33/04* (2013.01); *F02B 61/045* (2013.01); *F02B 2075/025* (2013.01); *F02F 1/22* (2013.01)

(58) Field of Classification Search

CPC ..... F10P 3/20; F01P 7/164; F01P 7/165; F01P 2025/32; F01P 2025/62

USPC ..... 123/41.02

See application file for complete search history.

(56) References Cited

U.S. PATENT DOCUMENTS

| | | | | |
|---|---|---|---|---|
| 6,352,055 | B1 | 3/2002 | Algrain et al. | |
| 7,128,026 | B2 | 10/2006 | Braun et al. | |
| 7,237,513 | B2 | 7/2007 | Pfeffinger et al. | |
| 2003/0106536 | A1 * | 6/2003 | Sass et al. | 123/494 |
| 2008/0071151 | A1 * | 3/2008 | Sogin et al. | 600/301 |
| 2010/0139582 | A1 * | 6/2010 | Bilezikjian et al. | 123/41.02 |
| 2010/0274102 | A1 * | 10/2010 | Teixeira | 600/301 |

FOREIGN PATENT DOCUMENTS

WO 03038251 A1 5/2003

* cited by examiner

*Primary Examiner* — Lindsay Low
*Assistant Examiner* — Charles Brauch
(74) *Attorney, Agent, or Firm* — Greg Brown; Alleman Hall McCoy Russell & Tuttle LLP

(57) ABSTRACT

A system and methods for inferring a local engine temperature based on various engine conditions input to a dynamic model are disclosed. In the example system provided, an inferential temperature sensor uses a trainable model to estimate a local metal temperature in an exhaust valve bridge of a cylinder head which thereby allows closed loop control of a coolant flow device independent from engine speed, engine state, coolant flow state or system temperature. In response to estimated local metal temperatures, the methods described further allow thermal management of the engine system to be optimized.

20 Claims, 8 Drawing Sheets

INFERRED ENGINE LOCAL TEMPERATURE ESTIMATOR

FIELD

The present description relates to a system and method for estimating a temperature in an engine system. The system and method may be particularly useful for estimating a local metal temperature in an exhaust valve bridge of a cylinder head.

BACKGROUND AND SUMMARY

Inferential sensors offer low cost alternatives for signal acquisition compared to hardware sensors whose inclusion may be difficult to implement in an engine in some instances. Furthermore, hardware sensors often indicate a bulk engine temperature that relates to an energy potential between a source and sink within the engine system and so do not capture the thermal state of certain engine regions, like the region near a combustion chamber, which can have a higher temperature and therefore exceed thresholds well before bulk temperature regions. When this is the case, useful energy may be inadvertently wasted that results in a suboptimal thermal management process.

In one example system, U.S. Pat. No. 7,237,513 selectively operates a coolant pump based on an engine operating state in order to shorten a heating time after a cold start. However, the system described uses a web sensor arranged in a web between an inlet valve and an outlet valve within the cylinder head to measure the temperature of the combustion chamber. As such, a sensor is used to measure the temperature in the cylinder head directly. In another example, U.S. Pat. No. 7,128,026 describes a method for influencing the heat balance of an internal combustion engine based on coolant temperatures. Therein, the system described is based on a bulk temperature measurement within the engine system and therefore may not represent various local engine temperatures, particularly in selected regions where the engine temperatures may be substantially higher.

The inventors have recognized disadvantages with the systems above and herein disclose an example system and method for operating a coolant pump independent of engine speed, and adjusting one or more parameters responsive to an inferred local metal temperature in the exhaust valve bridge of a cylinder head. In one particular example, the temperature estimator uses a trained neural network model to infer the exhaust valve bridge temperature of the aluminum material between the exhaust valve seats, which may have a higher local temperature than the bulk temperature measured by a sensor in some instances. Then, a controller may adjust the flow of coolant based on comparisons of the local temperature estimates to a temperature threshold and bulk or average engine temperature, which thereby allows the thermal load on the engine to be managed in accordance with the methods described.

The present description may provide several advantages. In particular, with an accurate metal temperature estimate, flow devices may be used to their full potential by not enforcing conservative conditional controls. In addition, the approach described allows a low cost alternative compared to methods that use a sensor directly in the region of the cylinder head, which presents packaging difficulties in the engine compartment and thereby increases the cost of production. Estimation of the exhaust valve bridge temperature also allows the real time characterization of parameters that cannot be measured directly using traditional hardware sensors. Furthermore, because local temperatures in this region may fluctuate dramatically, concerns related to traditional hardware sensor robustness over time may be substantially reduced. In addition, if the online estimator is implemented in a powertrain control module, the methods described allow for a reduction in the use of system storage and computational resources compared to other regressed physics-based models and conditionals.

The above advantages and other advantages, and features of the present description will be readily apparent from the following Detailed Description when taken alone or in connection with the accompanying drawings. It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

Figure 1:
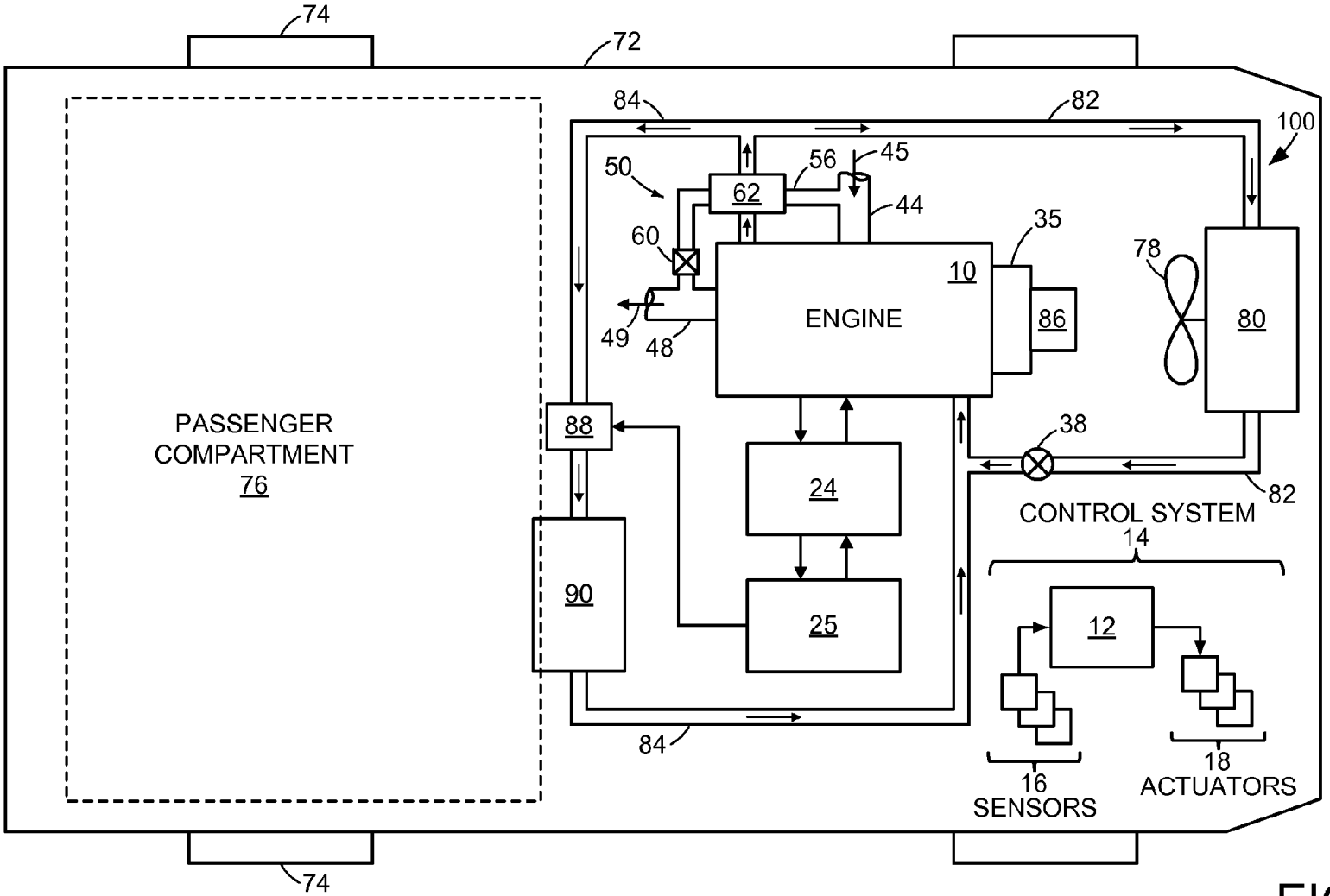
FIG. 1 shows a schematic diagram of an engine with a cooling system in a hybrid-electric vehicle.
Figure 5:
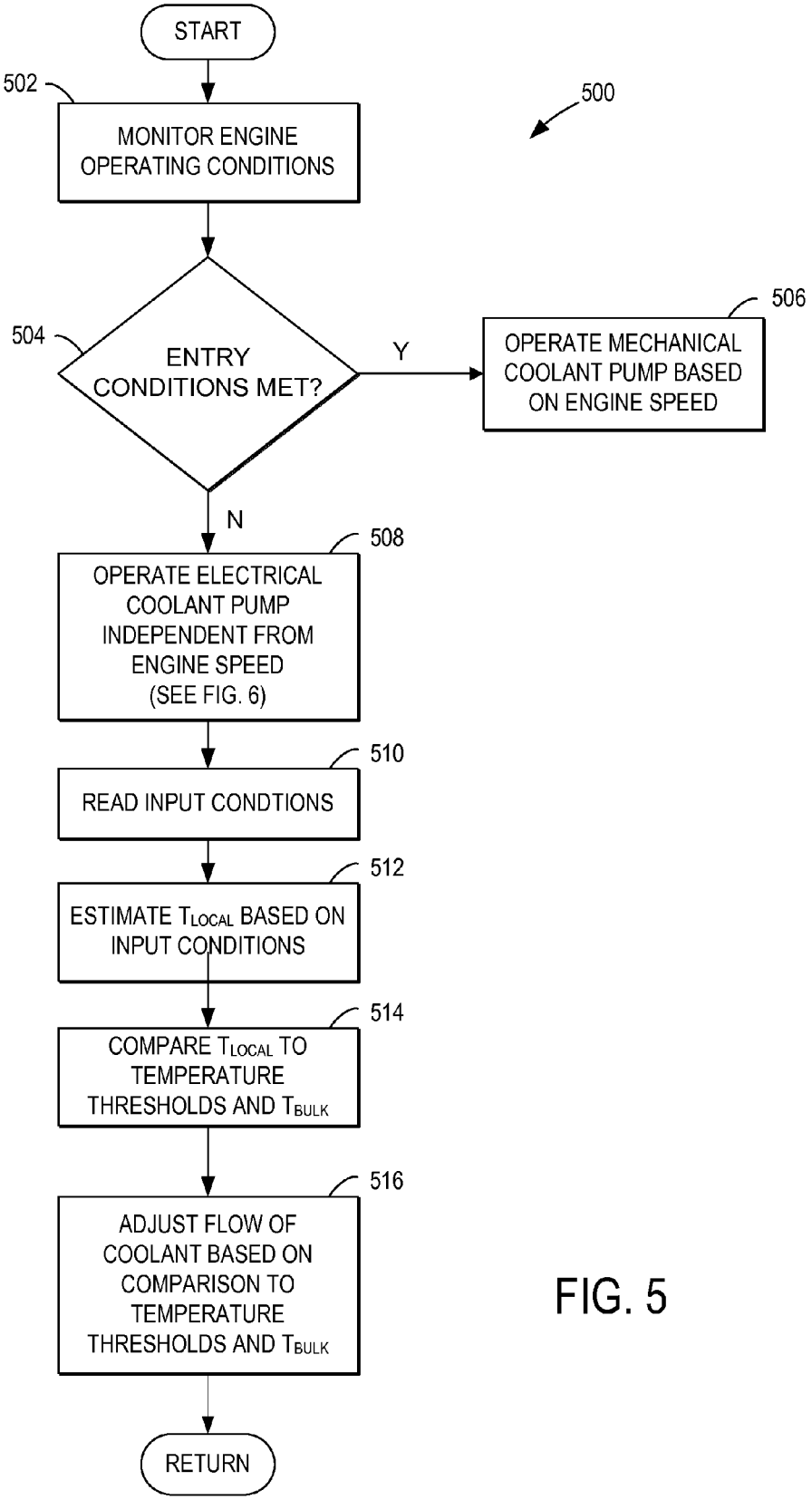
FIG. 5 is a flow chart of the method for adjusting the flow of coolant based on an estimated temperature in the engine system.
Figure 6:
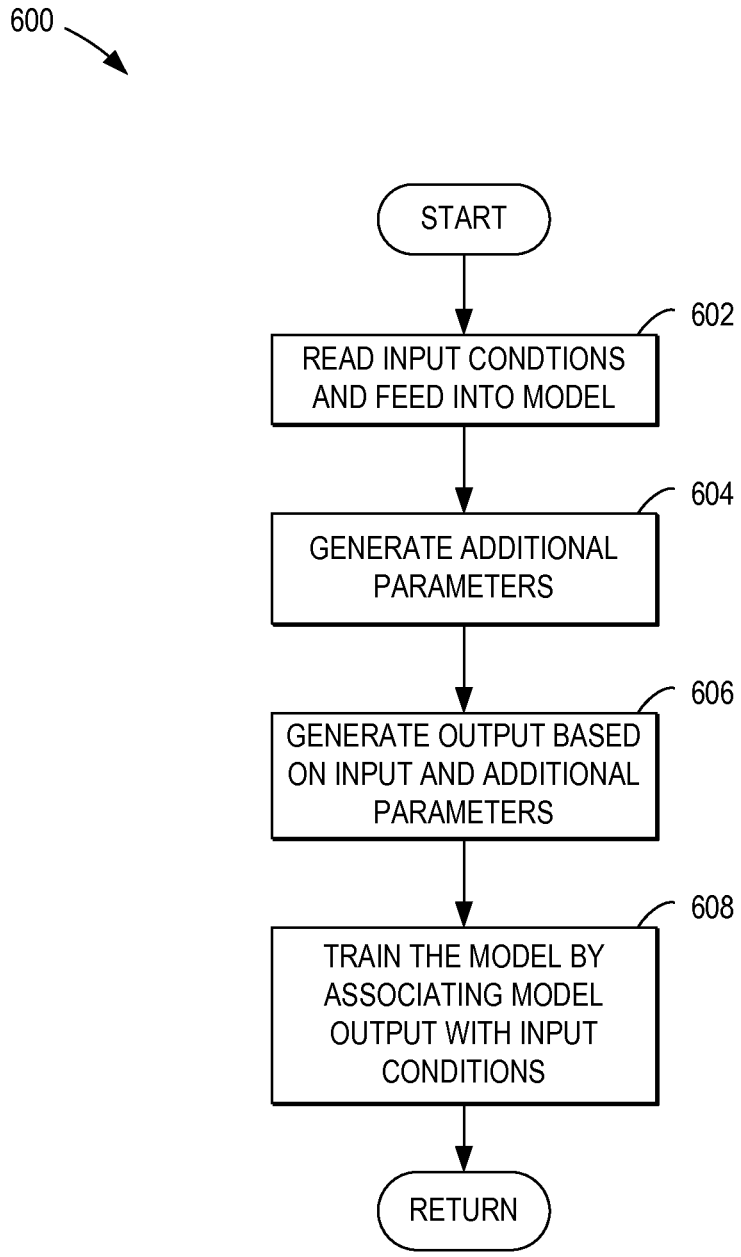
FIG. 6 is a flow chart of the method for training the model in accordance with the present disclosure.
Figure 7:
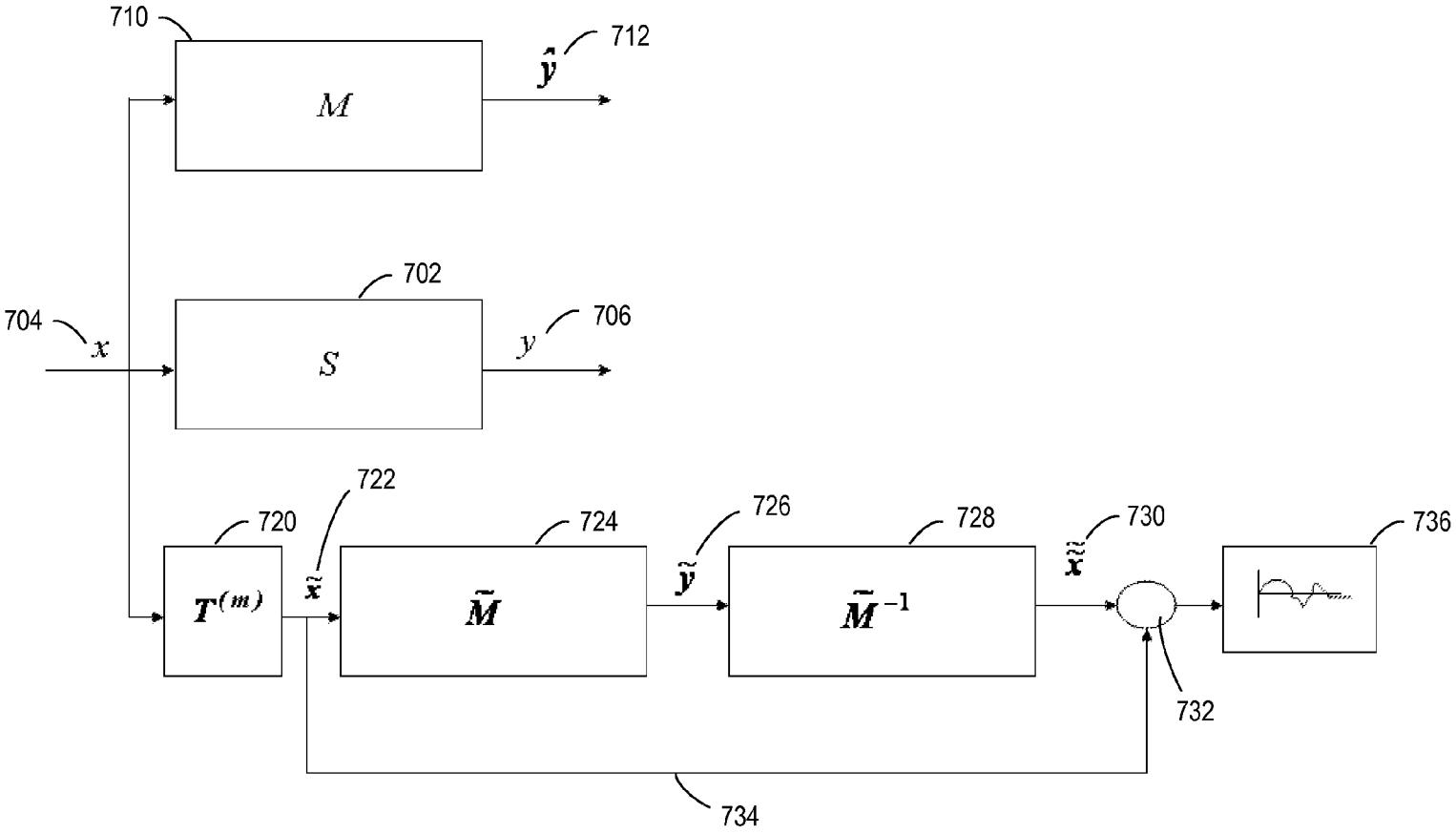
FIG. 7 is a schematic diagram illustrating how output from an inferential sensor is processed to determine the validity of temperature estimates produced.
Figure 8:
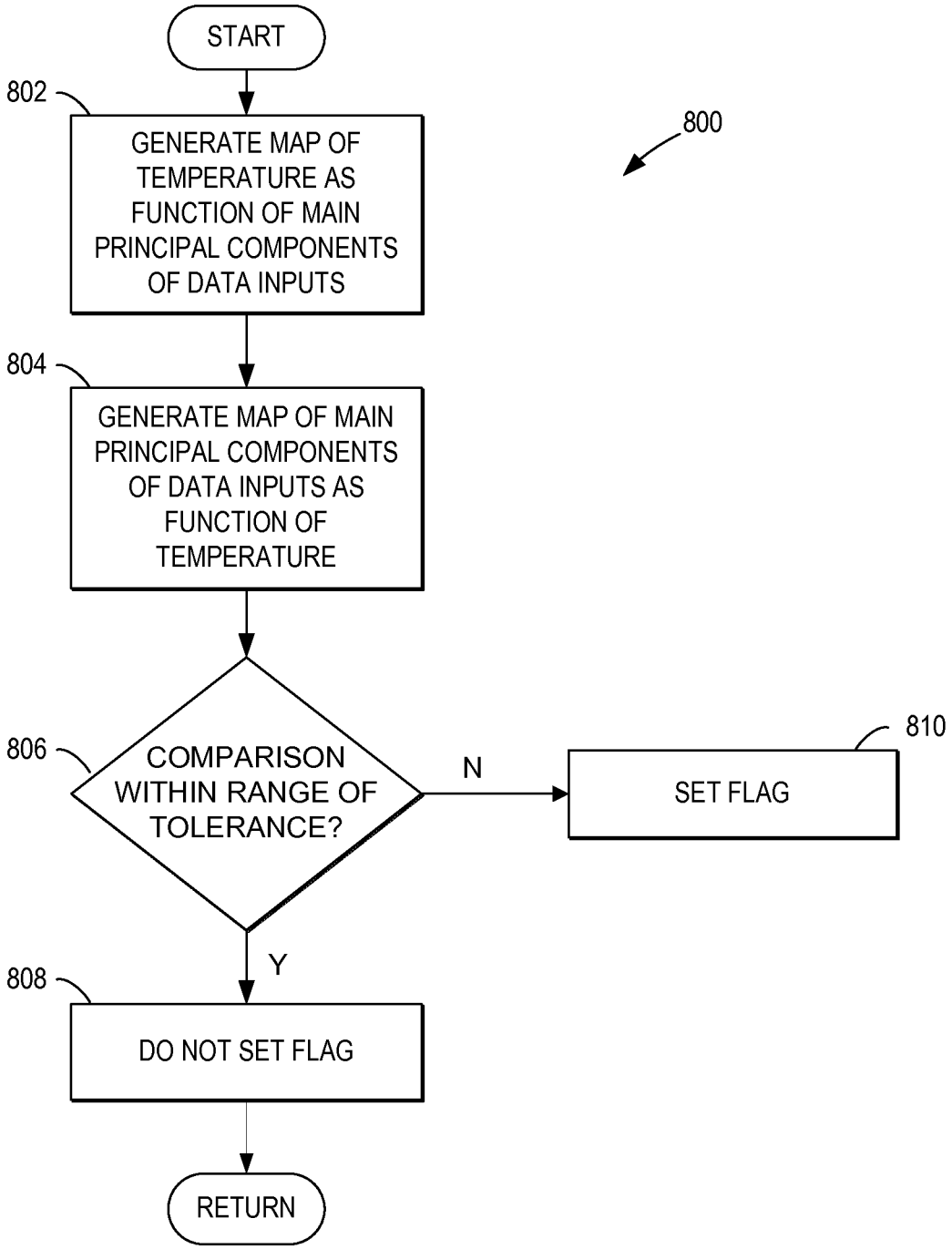
FIG. 8 is a flow chart of the method for validating an estimated temperature in an engine system.

The present description relates to a method for estimating a temperature in an engine system. In the example embodiment provided, the method is used to estimate a local metal temperature in an exhaust valve bridge where placement of a temperature sensor is difficult. Because the inferential method depends on engine parameters and operating conditions within the engine system, a schematic diagram of an example vehicle is shown in FIG. 1. Then, in FIGS. 2 and 3, schematic diagrams of example engine cylinders are shown to illustrate various features in accordance with the present disclosure. In FIG. 4, a top view of the engine bank is shown to further illustrate where the example local temperature is estimated relative to an example temperature sensor that measures a bulk temperature therein. Turning to control of the method, FIG. 5 shows a flow chart illustrating how one or more operating parameters may be adjusted based on the estimated temperature. Then, FIG. 6 illustrates how the method uses data collected to calibrate and train the temperature estimator, which thereby allows for increasingly accurate temperature estimations to be made. In FIGS. 7 and 8 relate to a method for determining the validity of temperature estimates to ensure that temperature estimates generated remain valid during the estimation process.

Turning now to FIG. 1, an example embodiment of a cooling system 100 in a motor vehicle 72 is illustrated schematically. Cooling system 100 circulates coolant through internal combustion engine 10 and exhaust gas recirculation cooler (EGR) 62 to absorb heat and distributes the heated coolant to radiator 80 and/or heater core 90 via coolant lines 82 and 84, respectively.

In particular, FIG. 1 shows cooling system 100 coupled to engine 10 and circulating engine coolant from engine 10, through EGR cooler 62, and to radiator 80 via coolant pump 86, and back to engine 10 via coolant line 82. Specifically, coolant pump 86 circulates coolant around passages in the engine block, head, etc., to absorb engine heat, which is then transferred via the radiator 80 to ambient air. The temperature of the coolant may be regulated by a thermostat valve 38, located in the cooling line 82, which may be kept closed until the coolant reaches a threshold temperature. In one embodiment, coolant pump 86 may be coupled to the engine via front end accessory drive (FEAD) 35 and/or a clutch that couples coolant pump 86 to a crankshaft of engine 10 so the pump rotates proportionally to engine speed via belt, chain, etc. during selected driving conditions. For example, during a first set of conditions (e.g. engine speed above a threshold speed and/or engine temperature above a threshold temperature), a mechanical clutch may couple coolant pump 86 to engine 10 such that the pump operation is tied to engine speed. Therefore, the coolant pump flow rate may be increased as engine speed increases independently of a cylinder head temperature estimate. However, during a second set of conditions (e.g. engine speed below the threshold speed and/or engine temperature below the threshold temperature), the coolant pump may be operated independent of engine speed via an electric motor responsive to the cylinder head temperature estimate. When operating in this mode, the operating may include increasing coolant pump flow rate in the manner described below as the cylinder head temperature estimate exceeds a threshold. While cooling system 100 may include an electric variable/clutched coolant pump system in one embodiment, in other embodiments, cooling system 100 may alternatively include an engine-driven coolant pump and/or an electric pump.

Fan 78 may be further coupled to radiator 80 in order to maintain airflow through radiator 80 when vehicle 72 is moving slowly or stopped while the engine is running. In some examples, fan speed may be controlled by controller 12. Alternatively, fan 78 may be coupled to coolant pump 86.

As shown in FIG. 1, engine 10 may include an exhaust gas recirculation (EGR) system 50. EGR system 50 may route a desired portion of exhaust gas from exhaust passage 48 to intake passage 44 via EGR passage 56. The amount of EGR provided to intake passage 44 may be varied by controller 12 via EGR valve 60. Further, an EGR sensor (not shown) may be arranged within EGR passage 56 and may provide an indication of one or more of pressure, temperature, and concentration of the exhaust gas. Alternatively, the EGR may be controlled based on an exhaust oxygen sensor and/or and intake oxygen sensor. Under some conditions, EGR system 50 may be used to regulate the temperature of the air and fuel mixture within the combustion chamber. EGR system 50 may further include EGR cooler 62 for cooling exhaust gas 49 being reintroduced to engine 10. In such an embodiment, coolant leaving engine 10 may be circulated through EGR cooler 62 before moving through coolant line 82 to radiator 80.

After passing through EGR cooler 62, coolant may flow through coolant line 82, as described above, and/or through coolant line 84 to heater core 90 where the heat may be transferred to passenger compartment 76, and the coolant flows back to engine 10. In some examples, coolant pump 86 may operate to circulate the coolant through both coolant lines 82 and 84. In other examples, such as the example of FIG. 1 in which vehicle 72 has a hybrid-electric propulsion system, an electric auxiliary pump 88 may be included in the cooling system in addition to the engine-driven pump. As such, auxiliary pump 88 may be employed to circulate coolant through heater core 90 during occasions when engine 10 is off (e.g., electric only operation) and/or to assist coolant pump 86 when the engine is running. Like coolant pump 86, auxiliary pump 88 may be a centrifugal pump; however, the pressure (and resulting flow) produced by pump 88 may be proportional to an amount of power supplied to the pump by energy storage device 25.

In this example embodiment, the hybrid propulsion system includes an energy conversion device 24, which may include a motor, a generator, among others and combinations thereof. The energy conversion device 24 is further shown coupled to an energy storage device 25, which may include a battery, a capacitor, a flywheel, a pressure vessel, etc. The energy conversion device may be operated to absorb energy from vehicle motion and/or the engine and convert the absorbed energy to an energy form suitable for storage by the energy storage device (e.g., provide a generator operation). The energy conversion device may also be operated to supply an output (power, work, torque, speed, etc.) to the drive wheels 74, engine 10 (e.g., provide a motor operation), auxiliary pump 88, etc. It should be appreciated that the energy conversion device may, in some embodiments, include only a motor, only a generator, or both a motor and generator, among various other components used for providing the appropriate conversion of energy between the energy storage device and the vehicle drive wheels and/or engine.

Hybrid-electric propulsion embodiments may include full hybrid systems, in which the vehicle can run on just the engine, just the energy conversion device (e.g., motor), or a combination of both. Assist or mild hybrid configurations may also be employed, in which the engine is the torque source, with the hybrid propulsion system acting to selectively deliver added torque, for example during tip-in or other conditions. Further still, starter/generator and/or smart alternator systems may also be used. Additionally, the various components described above may be controlled by vehicle controller 12 (described below).

From the above, it should be understood that the exemplary hybrid-electric propulsion system is capable of various modes of operation. In a full hybrid implementation, for example, the propulsion system may operate using energy conversion device 24 (e.g., an electric motor) as the only torque source propelling the vehicle. This "electric only" mode of operation may be employed during braking, low speeds, while stopped at traffic lights, etc. In another mode, engine 10 is turned on, and acts as the only torque source powering drive wheel 74. In still another mode, which may be referred to as an "assist" mode, the hybrid propulsion system may supplement and act in cooperation with the torque provided by engine 10. As indicated above, energy conversion device 24 may also operate in a generator mode, in which torque is absorbed from engine 10 and/or the transmission. Furthermore, energy conversion device 24 may act to augment or absorb torque during transitions of engine 10 between different combustion modes (e.g., during transitions between a spark ignition mode and a compression ignition mode).

FIG. 1 further shows a control system 14. Control system 14 may be communicatively coupled to various components of engine 10 to carry out the control routines and actions described herein. For example, as shown in FIG. 1, control system 14 may include an electronic digital controller 12. Controller 12 may be a microcomputer, including a microprocessor unit, input/output ports, an electronic storage medium for executable programs and calibration values, random access memory, keep alive memory, and a data bus. As depicted, controller 12 may receive input from a plurality of sensors 16, which may include user inputs and/or sensors (such as transmission gear position, gas pedal input, brake input, transmission selector position, vehicle speed, engine speed, mass airflow through the engine, ambient temperature, intake air temperature, etc.), cooling system sensors (such as coolant temperature, fan speed, passenger compartment temperature, ambient humidity, etc.), and others. Further, controller 12 may communicate with various actuators 18, which may include engine actuators (such as fuel injectors, an electronically controlled intake air throttle plate, spark plugs, etc.), cooling system actuators (such as air handling vents and/or diverter valves in the passenger compartment climate control system, etc.), and others. In some examples, the storage medium may be programmed with computer-readable data representing instructions executable by the processor for performing the methods described below as well as other variants that are anticipated but not specifically listed.

Figure 2:
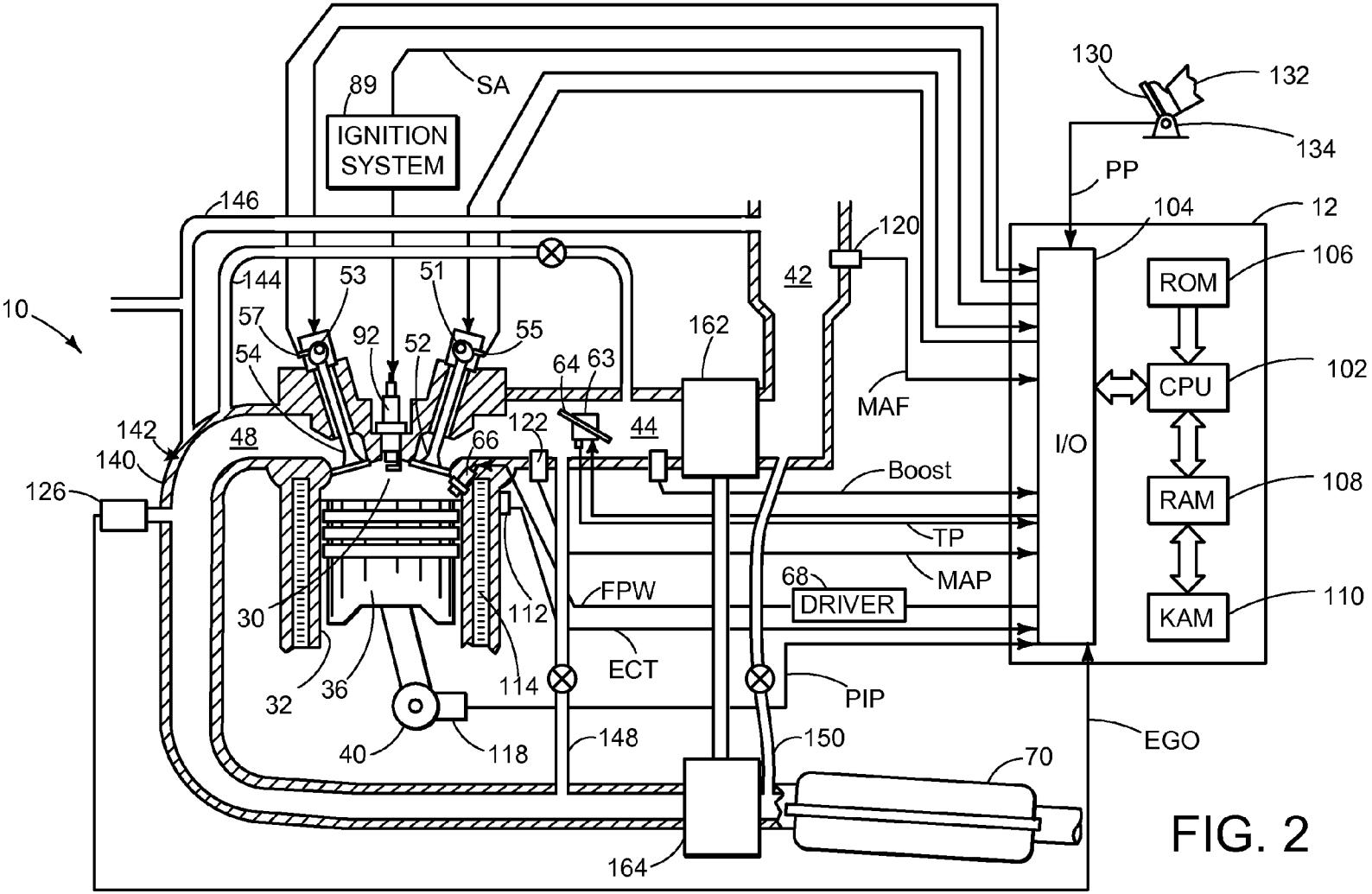
FIG. 2 shows a schematic diagram of one cylinder of an example engine in accordance with embodiments of the present disclosure

FIG. 2 shows an example diagram of one cylinder of multicylinder engine 10, which may be included in a propulsion system of an automobile. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber (or cylinder) 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Combustion chamber 30 may receive intake air from intake manifold 44 via intake passage 42 and may exhaust combustion gases via exhaust passage 48. Intake manifold 44 and exhaust passage (e.g., manifold) 48 can selectively communicate with combustion chamber 30 via respective intake valve 52 and exhaust valve 54. In some embodiments, combustion chamber 30 may include two or more intake valves and/or two or more exhaust valves.

In this example, intake valve 52 and exhaust valves 54 may be controlled by cam actuation via respective cam actuation systems 51 and 53. Cam actuation systems 51 and 53 may each include one or more cams and may utilize one or more of cam profile switching (CPS), variable cam timing (VCT), variable valve timing (VVT) and/or variable valve lift (VVL) systems that may be operated by controller 12 to vary valve operation. The position of intake valve 52 and exhaust valve 54 may be determined by position sensors 55 and 57, respectively. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

Fuel injector 66 is shown coupled directly to combustion chamber 30 for injecting fuel directly therein in proportion to the pulse width of signal FPW received from controller 12 via electronic driver 68. In this manner, fuel injector 66 provides what is known as direct injection of fuel into combustion chamber 30. The fuel injector may be mounted in the side of the combustion chamber or in the top of the combustion chamber, for example. Fuel may be delivered to fuel injector 66 by a fuel system (not shown) including a fuel tank, a fuel pump, and a fuel rail. In some embodiments, combustion chamber 30 may alternatively or additionally include a fuel injector arranged in intake manifold 44 in a configuration that provides what is known as port injection of fuel into the intake port upstream of combustion chamber 30.

Intake passage 42 may include a throttle 63 having a throttle plate 64. In this particular example, the position of throttle plate 64 may be varied by controller 12 via a signal provided to an electric motor or actuator included with throttle 63, a configuration that is commonly referred to as electronic throttle control (ETC). In this manner, throttle 63 may be operated to vary the intake air provided to combustion chamber 30 among other engine cylinders. The position of throttle plate 64 may be provided to controller 12 by throttle position signal TP. Intake passage 42 may include a mass air flow sensor 120 and a manifold air pressure sensor 122 for providing respective signals MAF and MAP to controller 12.

Ignition system 89 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Exhaust gas sensor 126 is shown coupled to exhaust passage 48 upstream of emission control device 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Emission control device 70 is shown arranged along exhaust passage 48 downstream of exhaust gas sensor 126. Device 70 may be a three way catalyst (TWC), NOx trap, various other emission control devices, or combinations thereof. In some embodiments, during operation of engine 10, emission control device 70 may be periodically reset by operating at least one cylinder of the engine within a particular air/fuel ratio.

Controller 12 is shown in FIG. 2 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Engine speed signal, RPM, may be generated by controller 12 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses every revolution of the crankshaft.

Storage medium read-only memory chip 106 can be programmed with computer readable data representing instructions executable by processor 102 for performing the methods described below as well as other variants that are anticipated but not specifically listed.

Engine 10 may further include a compression device such as a turbocharger or supercharger including at least a compressor 162 arranged along intake manifold 44. For a turbocharger, compressor 162 may be at least partially driven by a turbine 164 (e.g. via a shaft) arranged along exhaust passage 48. For a supercharger, compressor 162 may be at least partially driven by the engine and/or an electric machine, and may not include a turbine. Thus, the amount of compression provided to one or more cylinders of the engine via a turbocharger or supercharger may be varied by controller 12.

FIG. 2 further shows exhaust manifold 48 having a double wall exterior 140 defining an interstitial space 142 through which air may flow. The interstitial space may be manufactured similar to that of a liquid space. FIG. 2 further shows a conduit 144 connecting the interstitial space to the intake manifold 44. As such, when intake manifold pressure is less than ambient pressure, fresh air sourced via a fresh air conduit 146 may be drawn through interstitial space 142 to heat the air, and the heated air may then be directed to intake manifold 44 via conduit 144. Moreover, when intake manifold pressure is greater than ambient pressure, intake air may be drawn from intake manifold 44 via conduit 144 to interstitial space 142. The air is then drawn through the interstitial space 142 to cool exhaust gas. In this way, the double wall exhaust manifold 48 serves as an exhaust-to-air heat exchanger, sourcing hot air to intake manifold 44 for the intake stroke pumping benefit and warm-up benefit, and also cooling exhaust manifold 48 during high load operation by routing excess boost air through interstitial space 142. In this way, by heating the intake air, intake stroke pumping work may be reduced and engine warm-up enhanced, which thus increases the fuel economy. Further, use of heated positive crankcase ventilation (PCV) valve and/or heated throttle body may be eliminated, and the compressor bypass valve may be eliminated or reduced in size. Further, cooling of exhaust gas and/or exhaust components via enrichment with fuel or another fluid may be reduced or avoided. Also, lower temperature-rated materials may be utilized, and thus a cost savings may be achieved.

Further, a boosted engine may exhibit higher combustion and exhaust temperatures than a naturally aspirated engine of similar output power. Such higher temperatures may cause increased nitrogen-oxide (NOx) emissions from the engine and may accelerate materials ageing, including exhaust-aftertreatment catalyst ageing. Exhaust-gas recirculation (EGR) is one approach for combating these effects. EGR works by diluting the intake air charge with exhaust gas, thereby reducing its oxygen content. When the resulting air-exhaust mixture is used in place of ordinary air to support combustion in the engine, lower combustion and exhaust temperatures result. EGR may also increase fuel economy in gasoline engines by reducing throttling losses and heat rejection.

In boosted engine systems equipped with a turbocharger compressor mechanically coupled to a turbine, exhaust gas may be recirculated through a high pressure (HP) EGR loop 148 or through a low-pressure (LP) EGR loop 150. In the HP EGR loop 148, the exhaust gas is taken from upstream of the turbine 164 and is mixed with the intake air downstream of the compressor 162. In an LP EGR loop 150, the exhaust gas is taken from downstream of the turbine 164 and is mixed with the intake air upstream of the compressor 162.

HP and LP EGR strategies achieve optimum efficacy in different regions of the engine load-speed map. For example, on boosted gasoline engines running stoichiometric air-to-fuel ratios, HP EGR is desirable at low loads, where intake vacuum provides ample flow potential; LP EGR is desirable at higher loads, where the LP EGR loop provides the greater flow potential. Accordingly, in some embodiments, a control valve within conduit 144 may be opened when the system would benefit from warm, non-dilute air instead of the EGR-diluted air that may exist in the intake system due to previous operation. As an example, when the intake manifold pressure is greater than ambient pressure, the control valve within conduit 144 may be opened to discharge boost from the intake manifold, allowing the intake manifold pressure to decrease below ambient pressure, such that warm fresh air may be drawn from the double wall of the exhaust manifold through the conduit to replace the EGR-diluted air.

Moreover, during tip-out conditions where engine load suddenly decreases, a significant amount of unwanted, compressed intake air may be trapped upstream of throttle 63. As such, opening a control valve within conduit 144 may provide a blow-off mechanism for compressor 162. In this manner, excess boost pressure may be routed back to the compressor inlet when an EGR valve is closed.

As described above, FIG. 2 shows only one cylinder of a multi-cylinder engine, and each cylinder may similarly include its own set of intake/exhaust valves, fuel injector, spark plug, etc.

Figure 3:
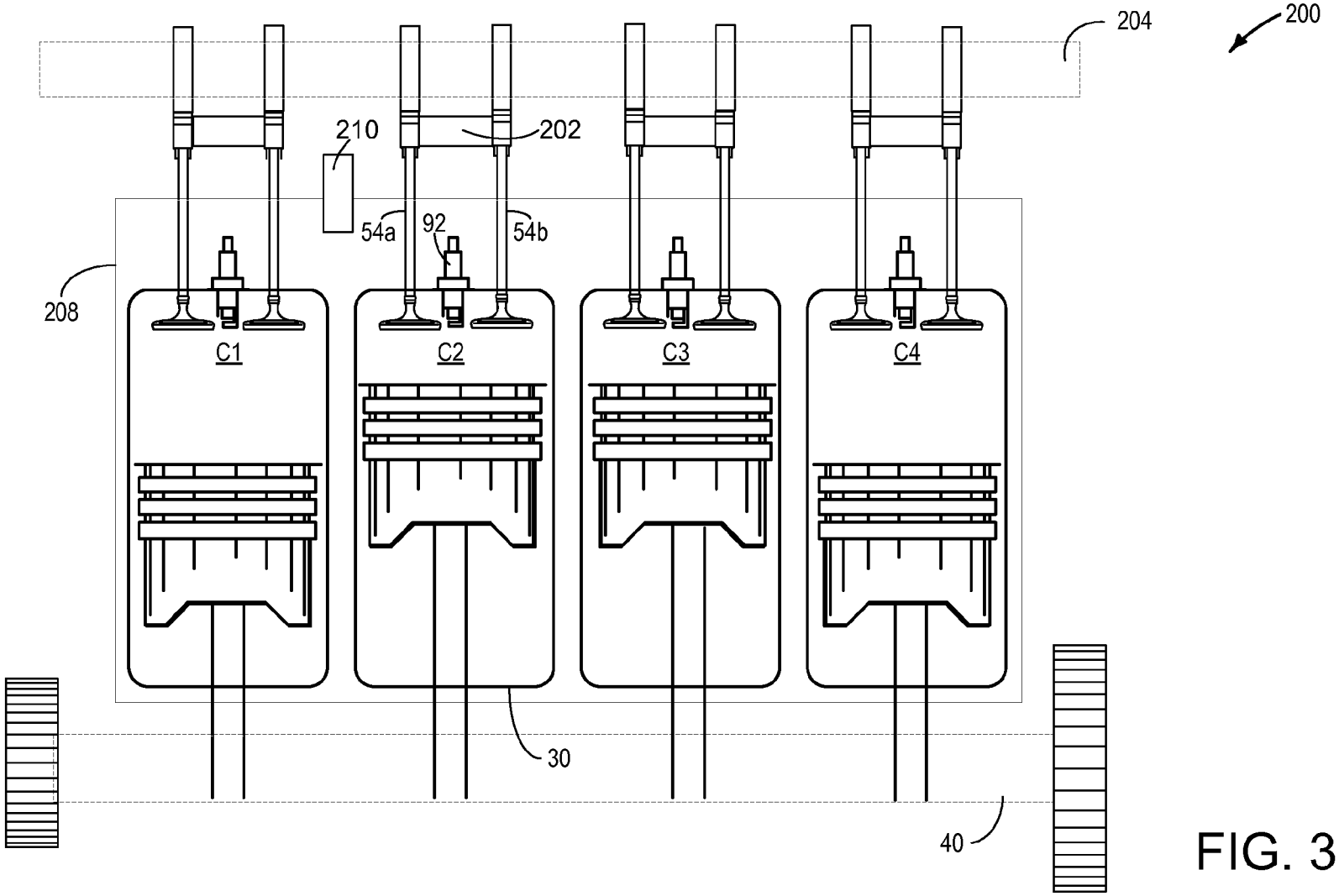
FIGS. 3 and 4 show various views of an example engine bank in accordance with the disclosure.
Figure 4:
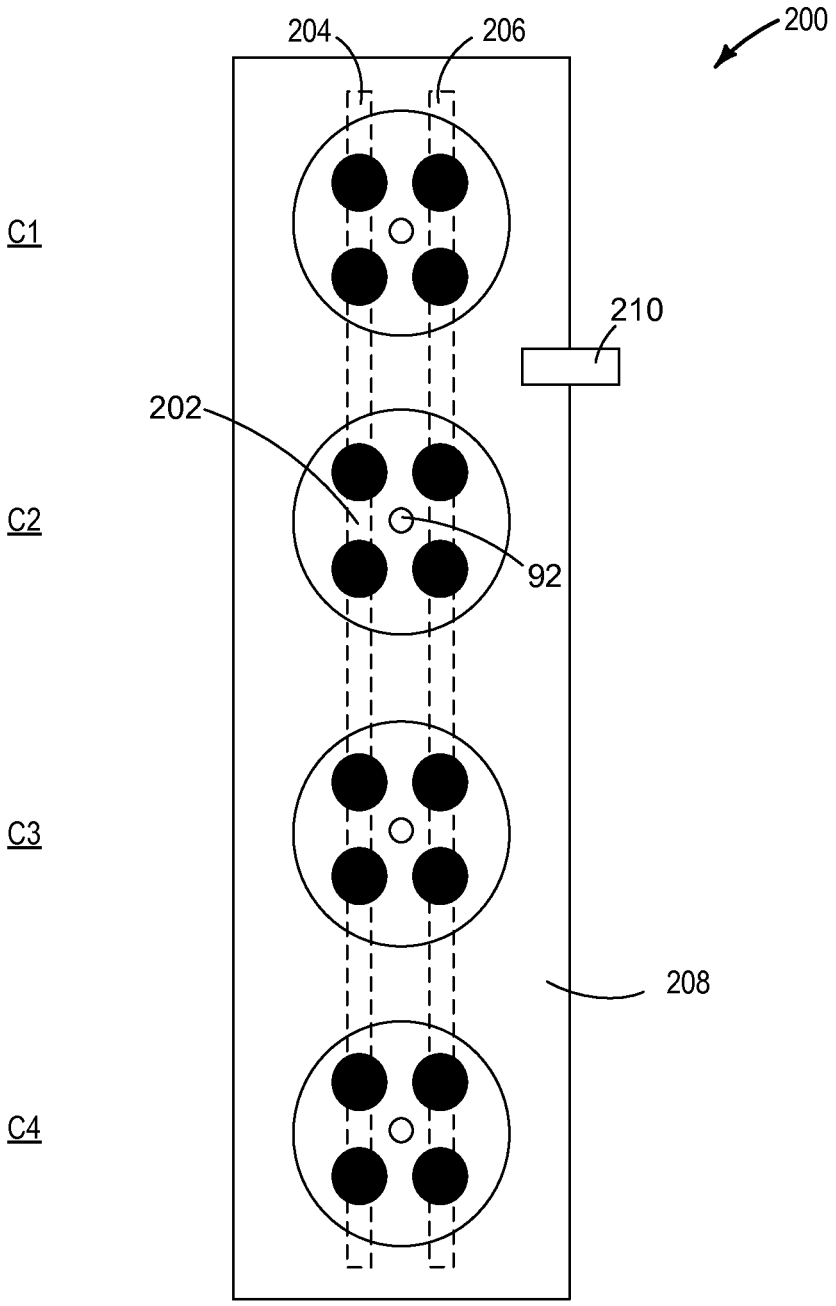

FIGS. 3 and 4 show an example engine bank 200, e.g., an engine bank of engine 10 described above, from a side view and a top view. Engine bank 200 includes a plurality of cylinders. As described above with respect to an example cylinder, engine bank 200 includes an intake manifold 44 configured to supply intake air and/or fuel to the cylinders 30 and an exhaust manifold 48 configured to exhaust the combustion products from the cylinders 30. Exhaust manifold 48 may include a plurality of outlets, each coupled to different exhaust components. In some examples, intake manifold 44 and exhaust manifold 48 may be integrated into the cylinder head. However, in other examples one or both of the intake and exhaust manifolds may be at least partially separated from the cylinder head.

In the example shown in FIGS. 3 and 4, engine bank 200 includes four cylinders, labeled C1, C2, C3, and C4, arranged in an inline configuration. Furthermore, cylinder C1 is positioned at a first end, e.g., a front end, of engine bank 200 and cylinder C4 is positioned at a second end opposing the first end, e.g., at a back end of engine bank 200. However, any number of cylinders and a variety of different cylinder configurations may be used, e.g., V-6, I-4, I-6, V-12, opposed 4, and other engine types.

Cylinders 30 may each include a spark plug and a fuel injector for delivering fuel directly to the combustion chamber, as described above in FIG. 2. However, in alternate embodiments, each cylinder may not include a spark plug and/or direct fuel injector. Cylinders may each be serviced by one or more gas exchange valves. In the present example, cylinders 30 each include two intake valves and two exhaust valves. Each intake and exhaust valve is configured to open and close an intake port and exhaust port, respectively. For example, in FIG. 3 exhaust valves 54*a* and 54*b* are shown for cylinder C2. In the same manner, cylinders C1, C3, and C4 also include two exhaust valves coupled to an exhaust camshaft.

Each exhaust valve is actuatable between an open position allowing exhaust gas out of a respective cylinder of the cylinders 30 and a closed position substantially retaining gas within the respective cylinder via an overhead exhaust camshaft 204. Exhaust camshaft 204 is also positioned in an overhead position above cylinders 30 adjacent to the top portion of engine bank 200. Exhaust camshaft 204 may include a plurality of exhaust cams configured to control the opening and closing of the exhaust valves. For clarity, in FIG. 4, intake camshaft 206 is also shown coupled to intake ports of engine bank 200.

Exhaust valve bridge 202 is shown for cylinder C2. In one embodiment, the cylinder head includes an exhaust valve bridge coupling a first exhaust valve to a second exhaust valve of the cylinder. For example, herein the exhaust valve bridge is a metal part made of aluminum that connects a pair of exhaust valves coupled to a cylinder so they operate in unison based on the rotational settings of exhaust camshaft 204. Because exhaust valves are exposed to a high flow rate of hot exhaust gases and a reduced rate of coolant jacket flow, the localized temperature in valve bridge 202 may be higher than the temperature in the combustion chamber. For example, in some instances, the exhaust valve bridge may be the hottest region in cylinder 30 and engine 10. As such, the temperature in this region may exceed a temperature threshold before bulk temperature indications from temperature sensors placed in other regions of the engine. It is therefore desirable to measure the temperature in this region of engine 10 and, in some instances, to further estimate the cylinder head temperature based on a modeled temperature of the exhaust valve bridge. Herein, the modeled cylinder head temperature may include a modeled exhaust valve bridge temperature, the exhaust valve bridge including a metal structure coupling a first exhaust valve of a cylinder to a second exhaust valve of the cylinder Placement of a temperature sensor in exhaust valve bridge 202 is difficult and may be impractical for vehicle production due to the increased cost associated with locating the sensor in this region of the engine. In addition, concerns arise related to sensor robustness since conditions in this part of the engine are generally harsh due to the intense local environment. Because of this, the methods described comprise estimating a temperature in the exhaust valve bridge of an engine while a coolant pump is operating independent of engine speed. Then, based on the local temperature estimated, the methods further include adjusting one or more parameters responsive to the estimated local temperature. For example, herein the operation of a coolant pump may be adjusted via an electric motor responsive to each of a bulk temperature of an engine block and a cylinder head temperature, wherein the bulk temperature is based on a sensor output, and the cylinder head temperature is modeled based on engine operating conditions. The adjusting of the operation of the coolant pump may further include adjusting initiating coolant pump operation (e.g. by engaging an electric pump) and/or adjusting a coolant pump flow rate while the coolant pump operates independent of speed. In order for this to occur, the method uses an inferential temperature sensor to determine the local metal temperature of exhaust valve bridge 202 that estimates the local temperature based on conditions within the engine. The methods further include controlling one or more other temperature dependent engine features including the flow of coolant around cooling system 100 within engine 10 based on the temperatures estimated using the inferential methods. Although estimation of the temperature of an exhaust valve bridge is used to exemplify the method, this particular example is non-limiting and the method is more generally relatable to determining localized temperatures based on one or more parameters within the engine system.

Because the methods rely on comparing an estimated local temperature to a bulk temperature, or the average temperature of a material, FIGS. 3 and 4 include temperature sensor 210 that measures the bulk temperature of engine block 208. As mentioned above, the local temperature measured in a region where no sensor is placed and a bulk temperature measured by a temperature sensor in another part of the engine can be substantially different.

As described above, FIGS. 1-4 show non-limiting examples of an internal combustion engine and associated intake and exhaust systems. It should be understood that in some embodiments, the engine may have more or less combustion cylinders, control valves, throttles, and compression devices, among others. Example engines may also have cylinders arranged in two banks of a "V" configuration. Additional elements not shown in FIGS. 3 and 4 may further include push rods, rocker arms, tappets, etc. Such devices and features may control actuation of the intake valves and the exhaust valves by converting rotational motion of the cams into translational motion of the valves. However, alternative camshaft (overhead and/or pushrod) arrangements could be used, if desired. Further, in some examples, cylinders 30 may each have only one exhaust valve and/or intake valve, or more than two intake and/or exhaust valves. In still other examples, exhaust valves and intake valves may be actuated by a common camshaft. However, in an alternate embodiment, at least one of the intake valves and/or exhaust valves may be actuated by its own independent camshaft or other device.

In order to estimate local metal temperatures, the example methods described use a model that is trained by associating model output and input conditions. For example, in the example methods included, a dynamic (or recurrent) neural network (RNN) is employed that uses several input parameters to generate a single output parameter, the estimated local temperature. In one embodiment, nine input parameters are used by the model to generate an estimated exhaust valve temperature. In order to train the models, which involves determining the weights of adjustable parameters within the RNN model, sample data may be collected and used by the dynamic model. For example, to train the RNN described, a thermocouple channel may be located in the metal of exhaust valve bridge 202 near the combustion chamber surface (e.g. within 2 mm) in an instrumented development engine. Though any of several training methods can be used, in the discussed approach, a multi-stream extended Kalman filter (EKF) training is disclosed as a non-limiting example.

FIG. 5 shows a flow chart of example method 500 wherein the flow of coolant is adjusted based on an estimated temperature in the engine system. Because method 500 uses various sensor data as input conditions when estimating the temperature, at 502, the method includes monitoring engine operating conditions. For example, controller 12 may read a pedal position signal from pedal position sensor 134 to determine the engine speed. However, in some embodiments, controller 12 may also or alternatively use other sensors within engine 10 to determine the speed of the engine. For instance, controller 12 may read data from a sensor coupled to the powertrain to determine the number of revolutions of a drive axle per unit time. In one embodiment, the method may be utilized in cold start drives when the engine temperature is low. In another embodiment, the method may be utilized in zero-flow hot shutdowns. In still a further embodiment, the method may be utilized in zero-flow short cold drives and mode changes from electrical to mechanical pump operation.

Based on data from one or more sensors, at 504, method 500 includes determining whether entry conditions have been met such that an output temperature is to be determined. Because cooling system 100 is shown with coolant pump 86 and electric auxiliary water pump 88, controller 12 may adjust actuators based on the operating conditions in order to optimize energy management within engine 10. For example, when a vehicle is warmed up so that its engine operates at a temperature above a threshold, the coolant pump may be driven at a fixed ratio off either the camshaft or crankshaft in order to supply coolant flow through the engine block and cylinder head. However, because the engine cooling pump is designed to provide adequate flow for cooling at peak power conditions, when a vehicle is operating under partial load conditions, the flow of coolant just described may be excessive in order to avoid nucleate boiling of the coolant. For this reason, an electric auxiliary coolant pump is often included to decouple the flow of coolant from engine speed. As such, controller 12 may be programmed with instructions to switch the cooling circuit between both modes of operation and thereby thermally manage the engine operations. Controller 12 may further include instructions for disabling the motor while engine speed is higher than the threshold speed and engaging the clutch to drive the coolant pump via engine rotation during selected operating conditions.

At 506, method 500 includes operating a mechanical coolant pump based on the speed of the engine when entry conditions are met. As described above, this may be based on the speed of the engine, for example, as determined by the number of drive axle revolutions per unit time, or it may be based on a temperature measured by a sensor within the engine. If controller 12 determines that the entry conditions are not met based on the current engine operating conditions, then at 508 method 500 may alternatively cool the engine using an electric auxiliary pump that operates independently of engine speed.

As such, controller 12 may engage an electric coolant pump so cooling of engine 10 is not coupled to engine speed during certain vehicle operating conditions. For example, during a cold start when the vehicle motor is first engaged upon ignition, the temperature of the engine may be low relative to the normal operating temperature. During this period of time, the flow of coolant may be low as heat from the engine is redirected within the vehicle system to warm up engine components. Alternatively, during the engine drive cycle a hybrid vehicle may switch between liquid or gaseous fuel and electric power to drive the vehicle. As such, during some operating conditions, for example, in high density traffic the engine may still be hot even though the engine speed is low. During these times, controller 12 may operate the electric coolant pump independently of engine speed. As a further example, because energy management may also include controlling the climate of a vehicle, for example, by regulating the temperature within passenger compartment 76, or using a cooler coupled to EGR 62, controller 12 may also consider data from sensors within the vehicle when operating the coolant pump independently of engine speed.

Measuring the bulk temperature within the engine, for example using temperature sensor 210 provides an indication of the energy potential at the sensor location relative to a heat source (e.g. a metal engine block surface) and a sink (e.g. coolant flowing through the engine block). However, during conditions when there is substantially no coolant flow, the bulk temperature sensor may not accurately represent the thermal state of various regions in the engine. The engine may therefore have localized hot regions even though the average or bulk temperature measured by a sensor located away from the local hot region indicates a cooler temperature. For example, as described above, the local metal temperature in an exhaust valve bridge may have a higher temperature relative to the bulk temperature of the engine block. As such, in some instances, it may be advantageous to estimate the local metal temperature in order to optimize the thermal management of the engine system.

At 510, method 500 includes compiling data from various sensors in the engine and inputting the conditions to a trainable model. Herein, a neural network model is used to exemplify the method. Based on the input conditions received, at 512 method 500 may process the data in order to generate a single output that estimates a local temperature ($T_{LOCAL}$) in the example engine system. At 514, method 500 further compares $T_{LOCAL}$ to a threshold in order to determine whether the flow of coolant in cooling system 100 is adequate for the conditions identified. Although the exemplary method described herein describes a threshold as the basis for adjusting actuators within the engine system, other embodiments are possible. For example, in another embodiment, a coolant flow setting may be tabulated as a function of $T_{LOCAL}$. Therefore, when $T_{LOCAL}$ is output from controller 12, actuators within engine 10 may be adjusted to automatically set a flow of coolant within the cooling system. In yet another embodiment, the coolant flow setting may consider $T_{LOCAL}$ and one or more vehicle parameters before making adjustments within the engine system.

Because an estimated local temperature may be different than the bulk temperature measured by a sensor, $T_{LOCAL}$ may be further compared to $T_{BULK}$ in order to determine whether the flow of coolant is to be adjusted. For example, if $T_{LOCAL}$ is above a first temperature threshold while $T_{BULK}$ falls below it, controller 12 may determine that cooling is to occur and adjust the flow of coolant based on the comparisons. For example, operating the electric coolant pump may include initiating pump operation at a lower engine speed based on $T_{LOCAL}$ than would otherwise occur based on the higher engine speed corresponding to $T_{BULK}$. Alternatively, if both $T_{LOCAL}$ and $T_{BULK}$ are above or below the first temperature threshold simultaneously, controller 12 may adjust the coolant flow based on the bulk temperature measured by a sensor within the engine compartment. Furthermore, in some instances, pump operation may be initiated based on a difference between the estimated temperature $T_{LOCAL}$ and the bulk temperature $T_{BULK}$ being above a second threshold. For instance, the difference between $T_{LOCAL}$ and $T_{BULK}$ may be large even though both temperatures fall below the first temperature threshold. As such, controller 12 may be programmed to adjust the flow of coolant based on a relatively large difference between the two temperatures.

At 516, method 500 includes adjusting a flow of coolant by adjusting actuators within the cooling system. For example, adjustments may be made responsive to a bulk temperature and cylinder head temperature by initiating coolant pump operation responsive to the cylinder head temperature above a threshold temperature while the bulk temperature is below the threshold temperature. As another example, adjustments may include increasing the coolant pump flow rate as a difference between the bulk temperature and the cylinder head temperature decreases while engine 10 being used. Furthermore, the adjusting may also include, operating the pump with a first, lower flow rate when the cylinder head temperature is above a threshold temperature and the bulk temperature is below the threshold temperature, and operating the pump with a second, higher flow rate when each of the cylinder head temperature and the bulk temperatures are above the threshold temperature. In some instances, while the engine speed is lower than a threshold speed, the method may include disengaging the clutch, actuating the electric motor responsive to a temperature of the exhaust valve bridge to operate the coolant pump independent of engine speed, and adjusting a pump flow rate based on each of the exhaust valve bridge temperature and the bulk engine temperature, the exhaust valve bridge temperature being estimated using a dynamic trainable model. Herein, actuating includes actuating the electric motor to operate the coolant pump in response to one of the exhaust valve bridge temperature being higher than a threshold, and a difference between the bulk temperature and the exhaust valve bridge temperature being higher than a threshold difference. Although the method is described using an example cooling system, this is not-limiting and one or more other adjustments may also or alternatively be made based on the estimated local temperature. Furthermore, the local variable estimated is not limited to temperature and may include other system variables so long as the environment under which the apparatus is working does not change or deviate substantially from the design specifications and the inputs to the inferential apparatus remain within a desirable range of validity.

In one example embodiment, the fuel economy of a vehicle may be increased by the method. For example, during cold start driving conditions, the engine may warm up faster if a water pump is operated independent of engine speed. By enabling the engine to warm up faster, parasitic loads may be reduced sooner in the trip and thereby reduce overall fuel consumption. Furthermore, when system temperatures are low, transmission oil pump, engine oil pump, and friction surfaces (e.g. pistons rings, bearing journals, valvetrain, etc.) may contribute to a cold fuel penalty whose load increases substantially with decreased starting temperatures. In order to schedule driver requested brake torque in the engine control strategy, such losses are accurately compensated for in operation of brake torque delivery. For example, strategies compensate for this loss in brake power output by scaling calibrated tables based on bulk coolant and/or metal temperature sensor(s). With a conventional fixed ratio water pump, forced convection is the dominant mode of heat transfer from metal structure to coolant. The heat transfer coefficient (HTC) is proportional to the velocity of coolant flow (or engine speed). Replacing the water pump with a variable electric coolant pump introduces a variable HTC independent of power output. For control of temperature dependent powertrain attributes such as friction, lost fuel, and inferred oil temperature, a bulk metal and/or coolant temperature sensor may be used as a control input to these features. Therefore, coolant flow, engine speed, load, and thermal mass of the sensor may contribute to the response of temperature indication over transient engine operations.

From a cold vehicle start at limited to no coolant flow, useful engine waste heat is absorbed by its available thermal capacitance (metal plus coolant) through conduction. The engine increases local oil film temperatures faster instead of warming bulk masses slowly. The local oil film temperature governs the magnitude of the cold friction parasitics, not the indicated bulk oil pan temperature. A caveat to low coolant flow during warm-up is the lack of temperature sensing in the combustion chamber. Bulk temperature indication from either a metal or coolant sensor does not provide an adequate amount of information to insure metal temperatures in the exhaust valve bridge area remain safe. Thus the inferential soft sensor according to method 500 functions as feedback in order to control an electric variable/clutched coolant pump system, which adds robustness to cooling system 100 while optimizing available waste energy during warm-up operations.

Turning to training of the model in accordance with the present disclosure, FIG. 6 shows a flow chart of method 600 that describes one method by which the model is trained. The intent of each test performed is to exercise the inputs of the model in a manner encompassing all drive conditions the engine may be subjected to in a vehicle. Basically, an array of transient and steady state operating conditions are sampled from engine dynamometer testing in both fixed and continuous operation using an instrumented development engine. Therefore, based on the testing methods employed, at 602, method 600 includes reading the input data into a model. As non-limiting examples, the engine conditions tested may include crowds (increasing engine speed at substantially constant manifold pressure), drive cycles, steady state speed/load sweeps, and torque step conditions. In one embodiment, the neural network model employed may use nine input parameters that include an indicated torque, engine speed, ignition timing, bulk cylinder head metal temperature, engine outlet coolant temperature, coolant pump speed, pump clutch state, exhaust manifold temperature, and ambient temperature.

Because a neural network model is employed, at 604, method 600 generates additional parameters, sometimes referred to as the hidden layer that can also be used by the control system. For instance, the nine input parameters described above can be used to generate three additional parameters based on the data received. In one embodiment, the three additional parameters are an engine state (e.g. engine on/off), a coolant flow state (e.g. flow on/off), and a temperature range (e.g. low/medium/high). In one example embodiment, the temperature range may be determined from a wax motor thermostat ($T_{STAT}$) being fully open, fully closed, or modulated somewhere in between. For instance, $T_{STAT}$ may be fully open beyond 95° C. and fully closed below 88° C. The function of $T_{STAT}$ modulation occurs from the balance of engine heat rejection and cooling system heat release to ambient. Although three parameters are used in this example, the number of parameters generated based on the input parameters is non-limiting. For example, in another embodiment, more or fewer than three parameters may also be generated based on the input parameters.

In one embodiment, a powertrain application based on the model may be implemented in place of a conventional FEAD driven coolant impeller pump with a hybrid electric/mechanical pump. Advantages of this pump include a default operation of a typical FEAD driven pump. Then, by engaging a solenoid clutch, the impeller can be uncoupled from the FEAD. In one example, an inline electric motor can control impeller speed up to approximately 2000 rpm. This provides additional coolant flow to various devices at idle without raising engine speed. With the electric motor function, pump 'run-on' can be employed to circulate coolant through a hot engine after shutdown to avoid after boil. With this capability the engine can be operated at much higher coolant temperatures above ambient and thereby increase the effectiveness of the cooling system.

Flow and engine flags along with temperature range may serve as mode operators. With each given mode, the model may be trained to enhance accuracy during operation. For example, the three parameters above may be used to define the following operators:

Engine ON/Flow ON/Temperature Range LOW=Climate heater core performance

Engine ON/Flow ON/Temperature Range MEDIUM=Nominal drive operation

Engine ON/Flow ON/Temperature Range HIGH=Hot drive operation

Engine OFF/Flow ON/Temperature Range MEDIUM=Start/Stop operation w/ heater

Engine OFF/Flow ON/Temperature Range HIGH=Hot shutdown

Engine OFF/Flow OFF/Temperature Range MEDIUM=Start/STOP operation w/o heater

Engine ON/Flow OFF/Temperature Range LOW=Cold start warm-up

Engine ON/Flow OFF/Temperature Range MEDIUM=Cooling on demand

At 606, method 600 uses the parameters generated to further generate a model output, which in this example case is a single output that estimates the temperature of exhaust valve bridge 202 in engine 10. Because the model is tested under many conditions, an output is generated for each test performed. Therefore, at 608, the model is trained by associating each output condition generated with a set of input conditions. For example, in one embodiment, a map of estimated temperatures (e.g. the output) may be created based on the nine input parameters that are measured by sensors in the engine system. Then, instead of relying on a sensor to directly measure a temperature within the system, controller 12 may simply read input data from sensors within the system to estimate, or infer, the temperature in this region of the engine. Based on the temperature estimated, controller 12 may then adjust actuators within the system to adjust a flow of coolant and thereby manage the thermal properties within the engine.

Because the methods described make temperature estimations based on various engine conditions, FIGS. 7 and 8 relate to one method for determining the validity of the data measured be an inferential sensor. In FIG. 7, a schematic diagram is shown that illustrates how output from various data sets is processed to determine the validity of the estimated temperatures. FIG. 8 shows an example flow chart illustrating one method by which the validation method is controlled.

In FIG. 7, the function S at 702 represents an inferential sensor that collects data on-board a vehicle by processing input data 704 and producing output data 706. In general, the function may be represented as $y=S(x)$ where the function may further include r inputs and m outputs. Because the outputs are not measured directly by a sensor, but are instead inferred based on conditions within the engine, controller 12 may further compare the inferential sensor data of S to data produced using a first model, e.g. a trainable model, as described above with respect to FIGS. 3-6. Model M at 710 may also process input data 704 to produce model data 712. This function is generally represented as $\hat{y}=M(x)$ and may be obtained by training a universal approximator, which may be a neural network model in one instance. Because the model may be based on training data from an instrumented development engine, the model data 712 may be different from output data 706 and so approximate the inferential sensor output. If the difference between the inferential sensor and model data is within a valid range such that $\|S(x)-M(x)\|<\epsilon$ then in one embodiment the estimation provided by the inferential sensor may be confirmed.

In order to ensure the validity of the estimate on-board a vehicle, herein an example process that further uses a companion model that complements the trainable model is described. For simplicity, the companion model also includes r inputs and m outputs as described above with respect to the inferential sensor and trainable model. In the example described below, a Principal Component (PC) transformation is performed on the r dimensional input in order to determine the validity of the estimated temperature.

The first step of the transformation process is to standardize the input vectors by calculating the mean and the covariance of the input training set: $x^s=(x-\bar{x})(\mathrm{diag}(\bar{P}))^{-0.5}$ where $\bar{x}$ is the mean and $\bar{P}$ is the covariance matrix of the N row input vectors x. Then, the standardized input vectors are further transformed to the mD space in order to reduce the number of inputs to the same number as the outputs. Principal Component (PC) Transformation is applied to extract the first m dominant principal components of the standardized input vectors $x^s$. By performing a Singular Value Decomposition (SVD) on the covariance matrix P of the standardized input vectors $x^s$ (e.g. $P=T\,P_o\,T'$), the Transformed Input Vectors (TIV) can be obtained. The TIV is an mD row vector containing the first m dominant PCs of the standardized input vector $x^s$. The transformation matrix $T^{(m)}$ is formed from the first m columns of the square "basis" matrix T according to the SVD transformation of the covariance matrix P. Therefore, transformation matrix 720 is shown in FIG. 7 along with $\tilde{x}=xT^{(m)}$, where $\hat{x}$ represents the transformed data 722.

The transformed data is further used to train a second model called the companion model $\tilde{M}$ at 724 where $\tilde{y}=\tilde{M}(\tilde{x})$ maps the transformed data 722 (e.g. $\tilde{x}$) to the companion output 726 (e.g. $\tilde{y}$). Because the companion model uses filtered data and therefore does not include all of the input information, it will in general produce temperature estimates having a reduced accuracy compared to the estimates made using the trainable model M (e.g. $\|S(x)-M(x)\|<\|S(x)-\tilde{M}(\tilde{x})\|$). When the method is functioning as intended, the companion model will, however, follow the general trend of the data compared to the sensor and trainable model and therefore capture the input-output relationships therein.

Advantages of the companion model are realized since the matrix has the same number of inputs and outputs. Therefore, in some instances, the matrix can be inverted to produce inverted matrix 728 and an inverse mapping 730 (e.g. $\tilde{\tilde{x}}=\tilde{M}^{-1}(\tilde{y})$) such that $\tilde{\tilde{x}}\approx\tilde{x}$ and $\|\tilde{x}-\tilde{M}^{-1}(\tilde{M}(\tilde{x}))\|<\delta$. One way to obtain an inverse mapping is to invert the role of inputs and outputs during the training process. When the model $\tilde{y}=\tilde{M}(\tilde{x})$ provides a reasonable approximation of the inferential sensor (based on its training) and since the inverse model $\tilde{\tilde{x}}=\tilde{M}^{-1}(\tilde{y})$ derives from the inversion, the difference 732 can be found by comparing the transformed data 722 and inverse mapping 730 using operation 734, or $\|\tilde{\tilde{x}}-\tilde{x}\|$. While the method remains valid, difference 732 may remain below a threshold until the model $\tilde{y}=\tilde{M}(\tilde{x})$ no longer represents the local temperature estimated. Therefore, a difference 732 exceeding a threshold may indicate a major change in the inferential sensor such that the estimates produced are no longer represented by the companion model $\tilde{y}=\tilde{M}(\tilde{x})$, and consequently the trainable model $\hat{y}=M(x)$. When this occurs, the validity of estimates may be compromised and the inferential sensor may not produce accurate local temperature estimates, which may indicate sensor degradation in some instances. By monitoring difference 732 over time, the relative error can be monitored by controller 12 that is programmed to apply statistical signal processing techniques. Dataplot 736 shows that the transformed and inverted data may be plotted as one means of viewing the output when making a determination of the validity of the sensor.

In general, the inferential sensor may be dependable as long as the underlying assumptions considered in its development are not violated after deployment into actual service in a vehicle system. The assumptions can be expressed as a valid range of values input to the inferential sensor where $\|S(x)-M(x)\|_{t_0}-\|S(x)-\tilde{M}(\tilde{x})\|_{t_\infty}<\epsilon$ the inequality is used to indicate that the physical system does not change substantially over time. If, however, the system changes due to aging or because of a component whose functionality has degraded, the exhaust valve bridge inferential temperature sensor estimates may become less accurate such that the inferential sensor model does not represent the current vehicle conditions. In this manner, the method shown in FIG. 7 may validate whether the inferential sensor is operating as designed.

Turning to control of the validation method, in FIG. 8, a flow chart is shown of example method 800 for validating an estimated temperature in an engine system. In one embodiment, a controller may compare data collected aboard the vehicle with stored maps of model data that indicate an acceptable working range based on the designed system. In some embodiments, the controller may further update the maps by checking online while the inferential sensor is deployed in a vehicle to determine whether the inferential sensor is operating as designed.

At 802, method 800 includes generating a map of exhaust valve bridge temperatures as a function of the main principal components of the inferential data inputs. As described above, the data stored may be generated using a companion model that generates output based on principal components of a neural network model. At 804, the method further includes generating a map of the main principal components of the inferential inputs as a function of the exhaust valve bridge temperature.

Based on a comparison of the two maps generated at 802 and 804, at 806, method 800 includes determining whether the difference between the two data sets are within a desired range of tolerance. For example, by comparing output from the trainable model to output from the companion model using operation 734 in FIG. 7, the method was used to determine whether the inferential sensor was operating as designed. Then, if controller 12 determines that the comparison is within a range of tolerance based on the evaluation, at 808, controller 12 may allow the inferential sensor to continue operating as designed by not setting a flag to indicate sensor degradation. Conversely, if the comparison falls outside a range of tolerance, at 810, controller 12 may set a flag within the vehicle indicating the input conditions are outside a range of validity and/or the physical environment within the vehicle where the inferential sensor operates has substantially changed beyond its design specifications, possibly as a result of aging.

In this way, the thermal load on the engine can be managed by estimating or inferring a local metal temperature in a select region of the engine where temperatures may be higher. Then, based on the methods, which allow real-time characterizations of temperatures, flow devices may be used to their full potential by not enforcing conservative conditional controls. Furthermore, because local temperatures in the selected region may fluctuate dramatically, concerns related to traditional hardware sensor robustness over time may be substantially reduced using the inferential soft sensor described herein.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The invention claimed is:

1. A method for an engine, comprising:

during a first condition, operating a coolant pump via a mechanical clutch coupling the pump to a crankshaft of the engine, the operating tied to engine speed and independent of a cylinder head temperature estimate; and during a second condition, operating the coolant pump via an energy conversion device comprising an electric motor and a generator, the operating independent of engine speed and responsive to the cylinder head temperature estimate.

2. The method of claim 1, wherein the cylinder head includes an exhaust valve bridge coupling a first exhaust valve of a cylinder to a second exhaust valve of the cylinder, and wherein the cylinder head temperature estimated is based on a modeled temperature of the exhaust valve bridge.

3. The method of claim 2, wherein during the first condition, the operating includes increasing coolant pump flow rate as engine speed increases, and wherein during the second condition, the operating includes increasing coolant pump flow rate as the cylinder head temperature estimate exceeds a threshold.

4. The method of claim 3, further comprising, during the second condition, modeling the exhaust valve bridge temperature using a first recurrent neural network model, input conditions of the model including one or more of engine torque, engine speed, ignition timing, bulk cylinder head metal temperature, engine outlet coolant temperature, coolant pump speed, pump clutch state, exhaust manifold temperature, and ambient temperature.

5. The method of claim 4, wherein the first model includes multi-stream extended Kalman filter (EKF) training.

6. The method of claim 5, further comprising, during the second condition, validating an output of the first model using a second model, the second model using a principal component transformation of inferential data inputs.

7. The method of claim 1, wherein the first condition includes engine speed being above a threshold speed and/or engine temperature being above a threshold temperature, and wherein the second condition includes engine speed being below the threshold speed and/or engine temperature being below the threshold temperature.

8. An engine method, comprising:

adjusting operation of a coolant pump via an energy conversion device comprising an electric motor and a generator responsive to each of a bulk temperature of an engine block and a cylinder head temperature, the bulk temperature based on a sensor output, the cylinder head temperature modeled based on engine operating conditions.

9. The method of claim 8, wherein adjusting the operation of the coolant pump includes adjusting initiation of coolant pump operation, and adjusting a coolant pump flow rate.

10. The method of claim 9, wherein the adjusting responsive to the bulk temperature and the cylinder head temperature includes, initiating coolant pump operation responsive to the cylinder head temperature being above a threshold temperature and the bulk temperature being below the threshold temperature, and increasing the coolant pump flow rate as a difference between the bulk temperature and the cylinder head temperature decreases.

11. The method of claim 9, wherein the adjusting includes, operating the pump with a first, lower flow rate when the cylinder head temperature is above a threshold temperature and the bulk temperature is below the threshold temperature, and operating the pump with a second, higher flow rate when each of the cylinder head temperature and the bulk temperature are above the threshold temperature.

12. The method of claim 8, wherein the cylinder head temperature modeled based on engine operating conditions includes modeling the cylinder head temperature using a first recurrent neural network model having multi-stream extended Kalman filter (EKF) training, the engine operating conditions input to the model including one or more of engine torque, engine speed, ignition timing, bulk cylinder head metal temperature, engine outlet coolant temperature, coolant pump speed, pump clutch state, exhaust manifold temperature, and ambient temperature.

13. The method of claim 12, wherein the modeled cylinder head temperature includes a modeled exhaust valve bridge temperature, the exhaust valve bridge including a metal structure coupling a first exhaust valve of a cylinder to a second exhaust valve of the cylinder.

14. The method of claim 13, wherein the modeled cylinder head temperature is validated using a second model, the second model using principal component transformation of inferential data inputs.

15. An engine system comprising:

an engine block;

an exhaust valve bridge coupling a first exhaust valve to a second exhaust valve within a cylinder, the exhaust valve bridge located on a cylinder head;

a cooling circuit having a cooling pump for controlling coolant flow around the engine block, the pump coupled to a crankshaft of the engine via a clutch, the pump further coupled to an energy conversion device comprising an electric motor and a generator;

a temperature sensor coupled to the engine block for measuring a bulk engine temperature;

a controller with computer-readable instructions for:

while engine speed is lower than a threshold speed, disengaging the clutch;

actuating the electric motor responsive to a temperature of the exhaust valve bridge to operate the coolant pump independent of engine speed; and adjusting a pump flow rate based on each of the exhaust valve bridge temperature and the bulk engine temperature, the exhaust valve bridge temperature estimated using a dynamic trainable model.

16. The engine system of claim 15, wherein the dynamic trainable model is a recurrent neural network model trained by associating output parameters with input conditions, the input conditions including one or more of an indicated engine torque, engine speed, ignition timing, bulk cylinder head metal temperature, engine outlet coolant temperature, coolant pump speed, pump clutch state, exhaust manifold temperature, and ambient temperature.

17. The engine system of claim 16, wherein the dynamic trainable model is a first model, and wherein the exhaust valve bridge temperature is further validated using a second, different model, the second model using principal component transformation.

18. The engine system of claim 17, wherein the actuating includes actuating the electric motor to operate the coolant pump in response to the exhaust valve bridge temperature being higher than a threshold, and wherein adjusting the pump flow rate includes increasing pump flow rate as a difference between the bulk temperature and the exhaust valve bridge temperature increases.

19. The engine system of claim 17, wherein the actuating includes actuating the electric motor to operate the coolant pump in response to one of the exhaust valve bridge temperature being higher than a threshold, and a difference between the bulk temperature and the exhaust valve bridge temperature being higher than a threshold difference.

20. The engine system of claim 15, wherein the controller includes further instructions for, while engine speed is higher than the threshold speed, disabling the motor;

engaging the clutch to drive the coolant pump via engine rotation.

* * * * *